United States Patent [19]

Wirz

[11] Patent Number: 4,582,316

[45] Date of Patent: Apr. 15, 1986

[54] DEVICE FOR WITHDRAWING PRINTED SHEETS FOR EXAMINATION OR SORTING PURPOSES

[75] Inventor: Arno Wirz, Bammental, Fed. Rep. of Germany

[73] Assignee: Heidelberger Druckmaschinen AG, Heidelberg, Fed. Rep. of Germany

[21] Appl. No.: 623,314

[22] Filed: Jun. 22, 1984

[30] Foreign Application Priority Data

Jun. 22, 1983 [DE] Fed. Rep. of Germany ..... 3322342

[51] Int. Cl.[4] ..... B65H 29/04

[52] U.S. Cl. ..... 271/300; 271/206

[58] Field of Search ..... 271/277, 300, 204, 206

[56] References Cited

U.S. PATENT DOCUMENTS 1,607,143 11/1926 White ..... 271/300 X 2,001,296 5/1935 Barber ..... 271/300 X

FOREIGN PATENT DOCUMENTS 208745 1/1924 United Kingdom ..... 271/300

1284704 8/1972 United Kingdom ..... 271/300

*Primary Examiner*—Richard A. Schacher

*Attorney, Agent, or Firm*—Herbert L. Lerner; Laurence A. Greenberg

[57] ABSTRACT

A device for withdrawing printed sheets from a delivery of a sheet-fed rotary printing machine for examination and sorting purposes, the delivery being a chain delivery with gripper rows attached to the chain and having grippers operable by cam control, withdrawal of the printed sheets being initiated by a delayed opening of the respective grippers, includes a first gripper-opening cam, means for releasing the first gripper-opening cam from a locked position thereof so that it is engageable with a rotating control cam for bringing the first gripper-opening cam into a position wherein opening of the grippers is effected and is prevented, a second gripper-opening cam for initiating a delayed opening of the grippers, the second gripper-opening cam being disposed downstream from the first gripper-opening cam in travel direction of the printed sheets, and means for feeding the printed sheets released from the grippers, when the grippers are opened, directly to a conveyance device for further transporting the printed sheets.

9 Claims, 5 Drawing Figures

DEVICE FOR WITHDRAWING PRINTED SHEETS FOR EXAMINATION OR SORTING PURPOSES

The invention relates to a device for withdrawing printed sheets from a delivery of a sheet-fed rotary printing machine for examination and sorting purposes, the delivery being a chain delivery with gripper rows attached to the chain and having grippers openable by cam control withdrawal of the printed sheets being initiated by a delayed opening of the respective grippers.

According to a conventional method of withdrawing printed sheets for examination or verification purposes, after the front sheet positioning stops have been folded down while the machine is running, the sheet is withdrawn manually at the correct instant, and the positioning stops rapidly folded up again. Especially in the case of high printing speeds of the machine and corresponding speed at which the sheet is fed, this type of sheet withdrawal is extremely difficult for the operator and places great demands upon his skill and dexterity. In addition thereto, under certain circumstances, there is a high risk of injury which must not be underestimated. Furthermore, the freshly printed sheets are often smeared.

According to the actual state of the art as represented in pertinent printed publications, reference must be made initially to British Pat. No. 782,298, which discloses an auxiliary means for supporting the aforementioned manual activity. By folding down the front sheet aligning stops, a sheet sliding surface is created, over which a test sheet is to be conveyed to the outside. The ability of this device to function presupposes basically a relatively late opening of the chain grippers, which is not possible today when the high printing velocities of modern printing machines are taken into account, and when one wishes to assure that under normal operating conditions the sheet to be piled will be arranged neatly and precisely flat and when one wishes to prevent the edges of the pile from becoming inexact i.e. non-aligned, due to the rebounding thereof from the sheet aligning stops.

Similar equipment is also described in German Pat. No. 394,052. The withdrawal of the printed sheets is described therein as being effected by putting the gripper-opening cam out of operation, so that the sheet is disengaged only later by means of a second gripper-opening cam. Just how the gripper-opening cam is put out of operation during the normal printing cycle is effected by a relatively complicated lateral displacement or adjustment thereof. Additionally, the further advanced printed sheet, after the delayed disengagement thereof by the chain grippers, is fed in a rather uncontrolled manner to an intermediate stacker, from which it can then be withdrawn.

As has been pointed out with reference to the aforementioned British patent, the operational characteristics are also in this case inadequate for high printing speeds and, consequently, does not come up to present-day requirements.

Japanese Published Non-Prosecuted Application No. 58-47749 for an Industrial or so-called or Petty Patent is also concerned with a sample or test sheet withdrawal device, according to which two successive gripper-opening cams have been provided, one of the two cams being engageable or rendered functional and disengageable or rendered non-functional by pivoting.

Due to the lateral disposition of the device for putting or setting the gripper-opening cam out of function, it is not possible for the operator manually to take over the delivered sample or test sheet directly. An additional delivery piling device is therefore required.

Moreover, both the exact instant of time and the duration for inactivating this gripper opening cam for the purpose of withdrawing a specific number of paper sheets by means of the mechanism shown therein is not pre-determinable unequivocally and with desired reliability.

It is accordingly an object of the invention to provide a device for withdrawing printed sheets due to which the aforementioned deficiencies are eliminated, and which ensures, moreover, at maximum printing speed, without imparing the printing quality, regardless of the type of paper used, that a safe and simple withdrawal of paper sheets will occur, especially without any risks to the operator.

With the foregoing and other objects in view, there is provided, in accordance with the invention, device for withdrawing printed sheets from a delivery of a sheet-fed rotary printing machine for examination and sorting purposes, the delivery being a chain delivery with gripper rows attached to the chain and having grippers openable by cam control, withdrawal of the printed sheets being initiated by a delayed opening of the respective grippers, comprising a first gripper-opening cam, means for releasing the first gripper-opening cam from a locked position thereof so that it is engageable with a rotating control cam for bringing the first gripper-opening cam into a position wherein opening of the grippers is effected and is prevented, a second gripper-opening cam for initiating a delayed opening of the grippers, the second gripper-opening cam being disposed downstream from the first gripper-opening cam in travel direction of the printed sheets, and means for feeding the printed sheets released from the grippers, when the grippers are opened, directly to a conveyance device for further transporting the printed sheets.

In accordance with another feature of the invention, there are provided pivot means whereon the first gripper-opening cam is pivotally mounted, and means for urging the first gripper-opening cam under spring bias into engagement with an arresting lever and with the control cam, respectively.

In accordance with a further feature of the invention, the arresting lever of the releasing means is manually actuable for bringing the first gripper-opening cam into the position wherein opening of the grippers is effected and is prevented.

In accordance with an additional feature of the invention, there are provided, electromechanical means for actuating the arresting lever so as to bring the first gripper-cam into the position wherein opening of the grippers is effected and is prevented.

In accordance with an added feature of the invention, the electromechanical means comprise a magnetic switch activatable via a selector switch for actuating the arresting lever so that a varying number of the printed sheets can be withdrawn selectively.

In accordance with yet another feature of the invention, a counting device engaging said control cam for counting the number of the printed sheets which are withdrawn.

In accordance with yet a further feature of the invention, the control cam has a rise formed therein via which the arresting lever is automatically returnable under spring bias at a predetermined time to an initial position thereof.

In accordance with yet an added feature of the invention, the second gripper-opening cam is stationary, and the conveyance device is located close to the second gripper-opening cam, the conveyance device comprising a guide channel and transport rollers cooperating with the guide channels for feeding to the outside a printed sheet disengaged from the grippers.

In accordance with an alternate feature of the invention, there is provided lateral frame walls supporting the delivery, the releasing means comprising a pawl mechanism with actuating means therefor located at an end region of one of the lateral frame walls.

In accordance with the invention also, in a simpler yet, but nevertheless safe and efficient construction there is provided a device for withdrawing printed sheets from a delivery of a sheet-fed rotary printing machine for examination and sorting purposes, the delivery being a chain delivery with gripper rows attached to the chain and and having grippers openable by cam control, withdrawal of the printed sheets being initiated by a delayed opening of the respective grippers, comprising a gripper-opening cam in the form of a disc and mounted on a rotatable shaft, and pivot means engageable with the gripper-opening cam for effecting a delayed opening of the grippers, the gripper-opening cam being turnable by the pivot means through a given rotary angle and being brought thereby into two end positions.

In accordance with still another feature of the invention, the pivot means comprise a drawbar directly engaging the gripper-opening cam, the drawbar having an end thereof projecting beyond an end region of a side wall whereon the chain delivery is supported, and a handle mounted on the drawbar end for manually moving the pivot means horizontally in an opposite the direction of travel of the printed sheets.

In accordance with still a further feature of the invention, the pivot means comprise a compression spring and a stop therefor for retaining the gripper-opening cam in a given position for forming a sheet pile.

In accordance with a concomitant feature of the invention, there are provided conveying means comprising a guide channel and a suction roller cooperating with the guide channel for feeding to the outside a printed sheet disengaged from the grippers by delayed opening of the grippers and transferred to the conveying means.

Other features which are considered as characteristic for the invention are set forth in the appended claims.

Although the invention is illustrated and described herein as embodied in device for withdrawing printed sheets for examination or sorting purposes, it is nevertheless not intended to be limited to the details shown, since various modifications and structural changes may be made therein without departing from the spirit of the invention and within the scope and range of equivalents of the claims.

The construction and method of operation of the invention, together with additional objects and advantages thereof will be best understood from the following description of specific embodiments when read in connection with the accompanying drawings, in which.

Figure 1:
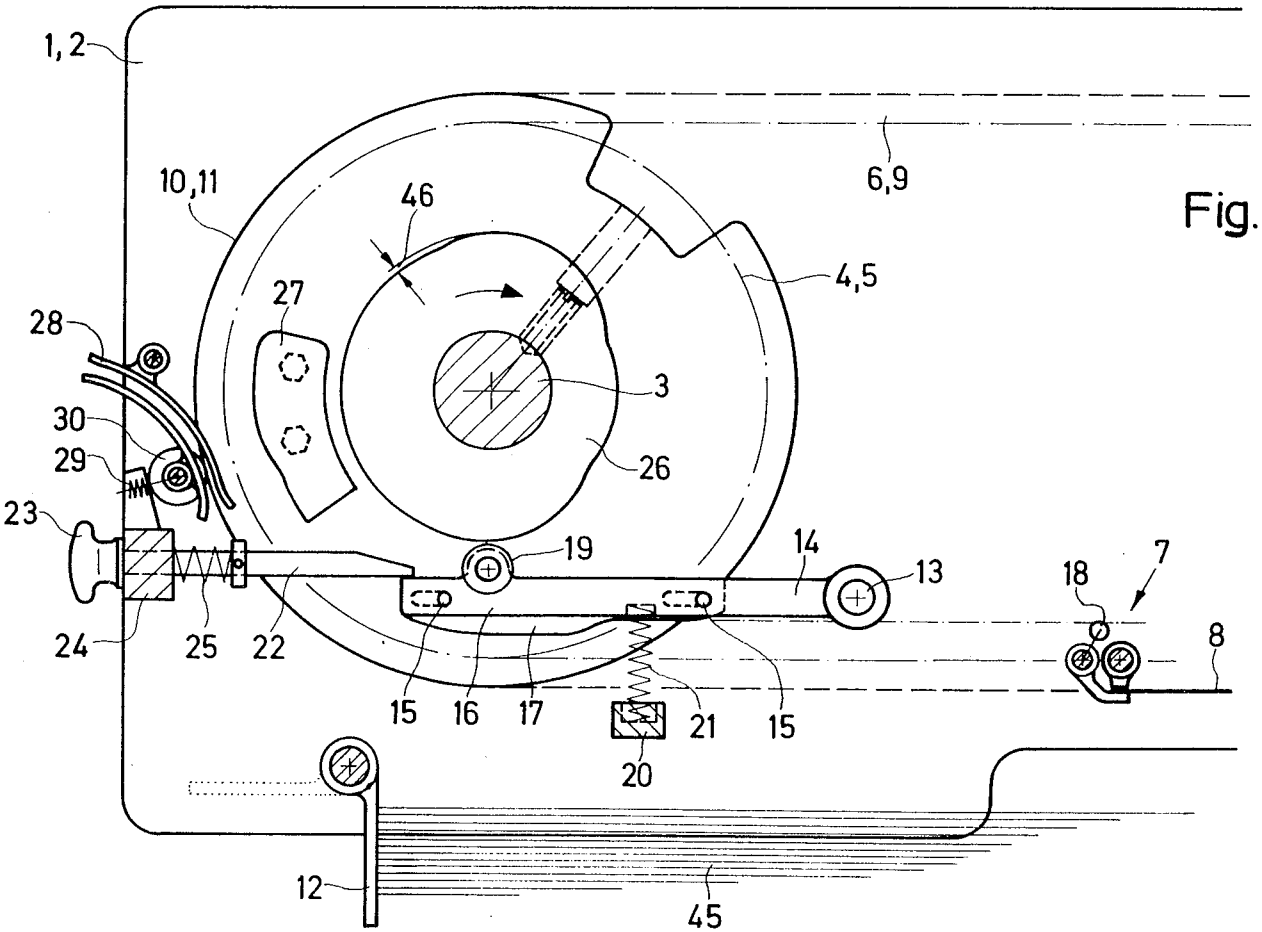
FIG. 1 is a diagrammatic side elevational view of a read sprocket wheel of a chain delivery, together with a device for withdrawing printed sheets according to the invention.
Figure 2:
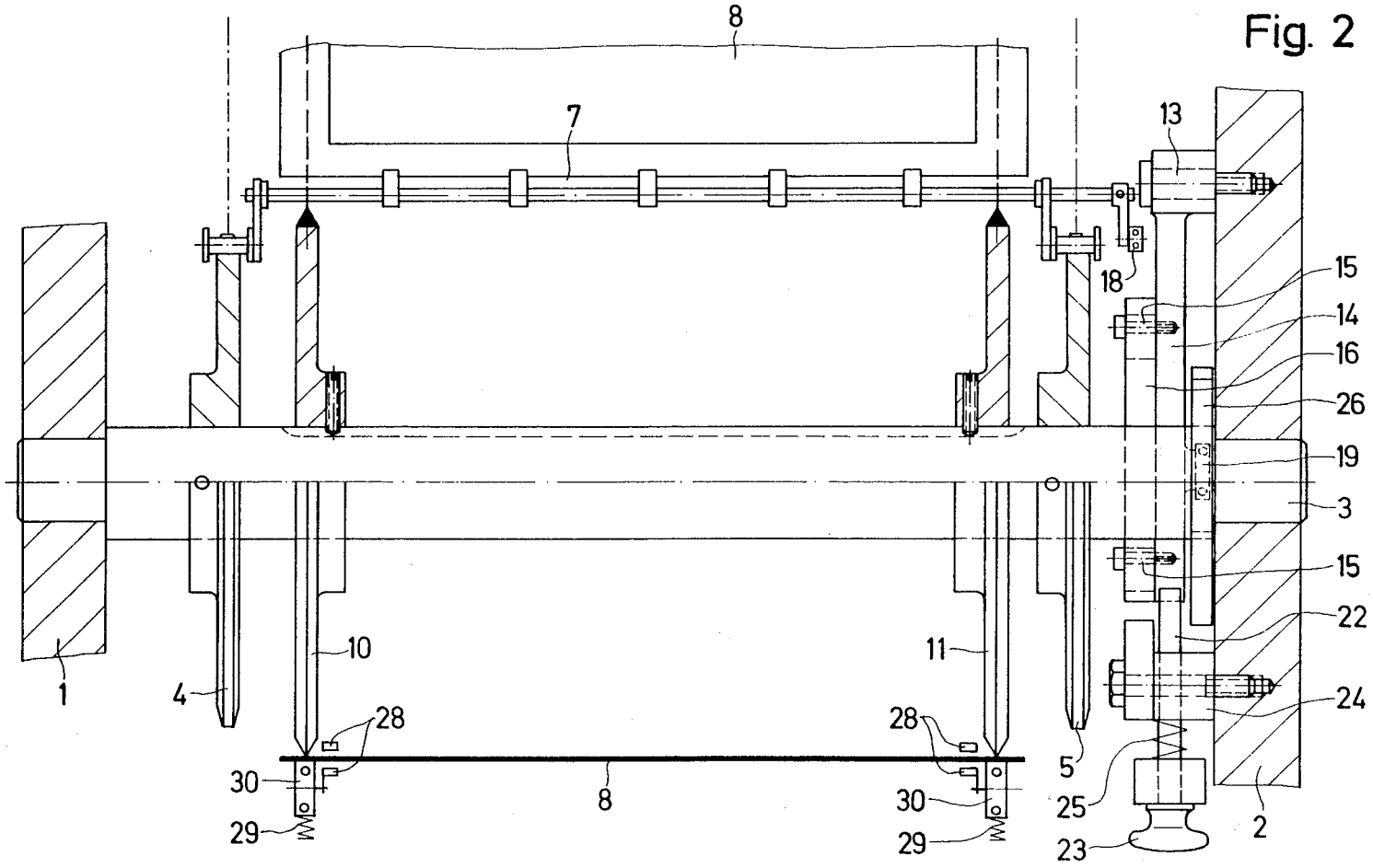
FIG. 2 is a top plan view, partly in section, of a region of the chain delivery according to FIG. 1.

Referring now to the drawing and first, particularly, to FIGS. 1 and 2 thereof there is shown a rear part of a sheet delivery. On a shaft 3 journalled in lateral walls 1 and 2, rear sprocket wheels 4 and 5 are mounted fixed against rotation. On these sprocket wheels 4 and 5, gripper chains 6 and 9 run and, at specific spacings, are provided with gripper rows 7 which feed a paper sheet 8 to a pile 45 of similar sheets.

Also, two support discs 10 and 11 are arranged on this shaft 3 axially displaceable thereon but fixed against rotation relative thereto. The support discs 10 and 11 support or aid in transfer for the sheets, especially in connection with the withdrawal of printed sheets according to FIG. 3. Front sheet stops 12 additionally provide for a neat pile formation.

At an articulated point 13 of one of the lateral panels or side walls 2, a swivelling lever 14 is rotatably mounted. This swivelling lever 14 carries a cam lever 16 secured by two retaining screws 15 is equipped with a gripper opening cam 17, over the surface of which a cam roller 18 of the gripper row 7 rolls for the delivery of the sheets to the sheet pile, and thus causes the grippers to open. In a front section of the cam lever 16, there is another cam roller 19 which is rotatably carried thereby. This latter roller 19 does not, however, fulfill any function related to the pile-forming sheet delivery.

A compression spring 21 action upon the cam lever 16 and bracing itself against a holding device 20 fixed to the lateral wall section 2, forces the swivelling lever 14, together with the cam lever 16 affixed thereto, against an arresting lever 22. The arresting lever 22, which is provided with a handle 23 fixed at an end portion thereof protruding, respectively, from the delivery and from an end region of the side wall section 2, is held and guided by a bearing block 24 and is additionally retained in the position illustrated in FIG. 1 by a spring 25.

Figure 3:
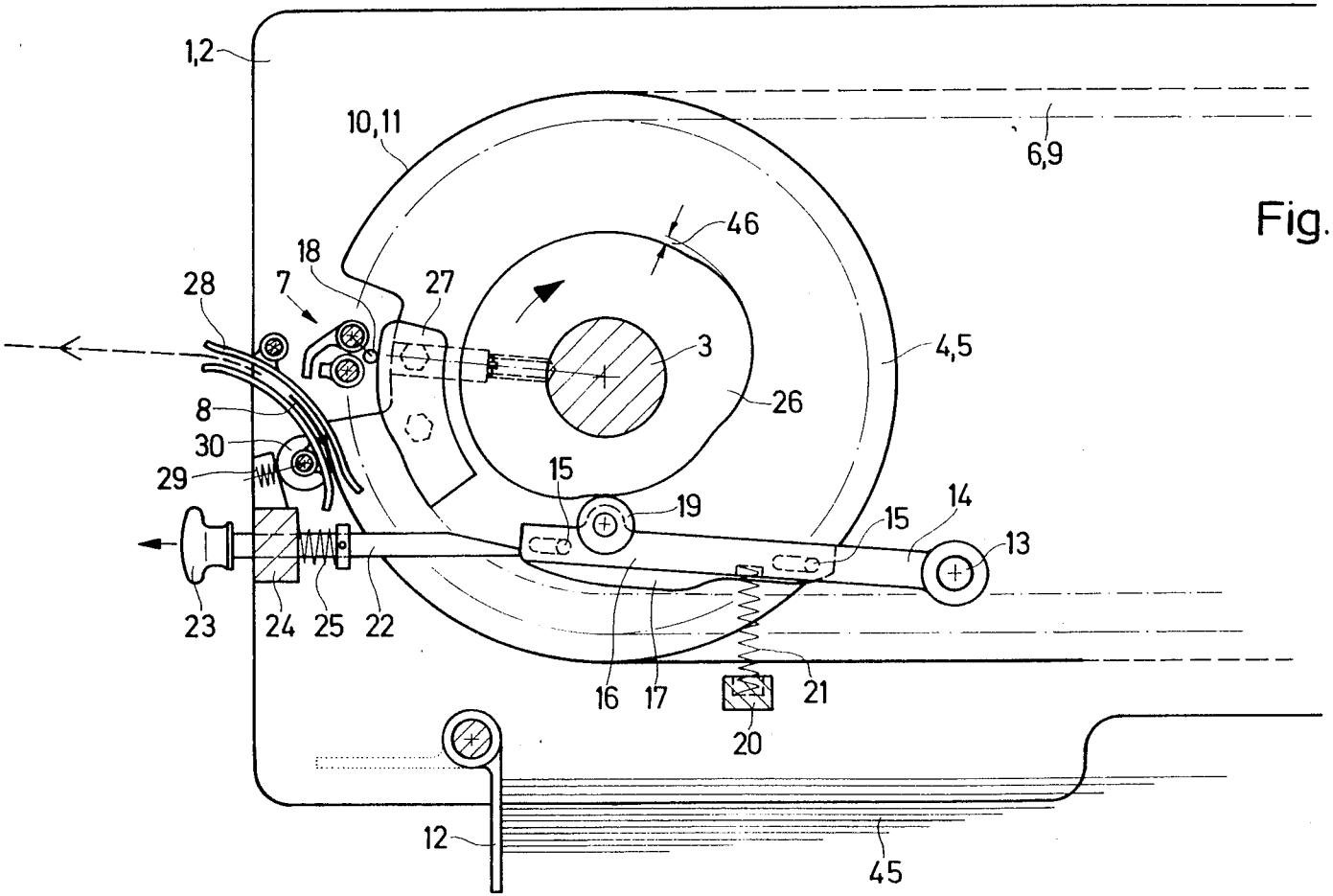
FIG. 3 is another view of FIG. 1 showing the device of the invention in a specific position permitting withdrawal of printed sheets.

FIG. 3, finally, shows the printed sheet withdrawal device in the position in which it is to perform the operation for which it has been provided. To this effect, the arresting lever 22 is drawn rearwardly i.e. against the resilient force of the compression spring 25, so that, respectively, the cam lever 16 and the cam roller 19 attached thereto, under the effect of the compression spring 21, can engage the control cam 26 which is rigidly fixed on and rotatable with the shaft 3. The phase relationship or position of the control cam 26 is selected so that when passing along the gripper element row 7, the cam roller 18 does not come into contact with the gripper opening cam 17, thus preventing disengagement of the sheet 8. The sheet is further transported until the cam roller 18 comes into contact with another gripper opening cam 27 which is stationary. The then initiated opening of the gripper row 7 disengages the sheet which then runs into a guiding channel 28 arranged at the rear end of the delivery, and guided from there outwardly. Further conveyance of the paper sheet 8 to be delivered is ensured by conveying or transport rollers 30 which are spring-mounted by compression springs 29 and supported by the supporting discs 10 and 11.

Figure 4:
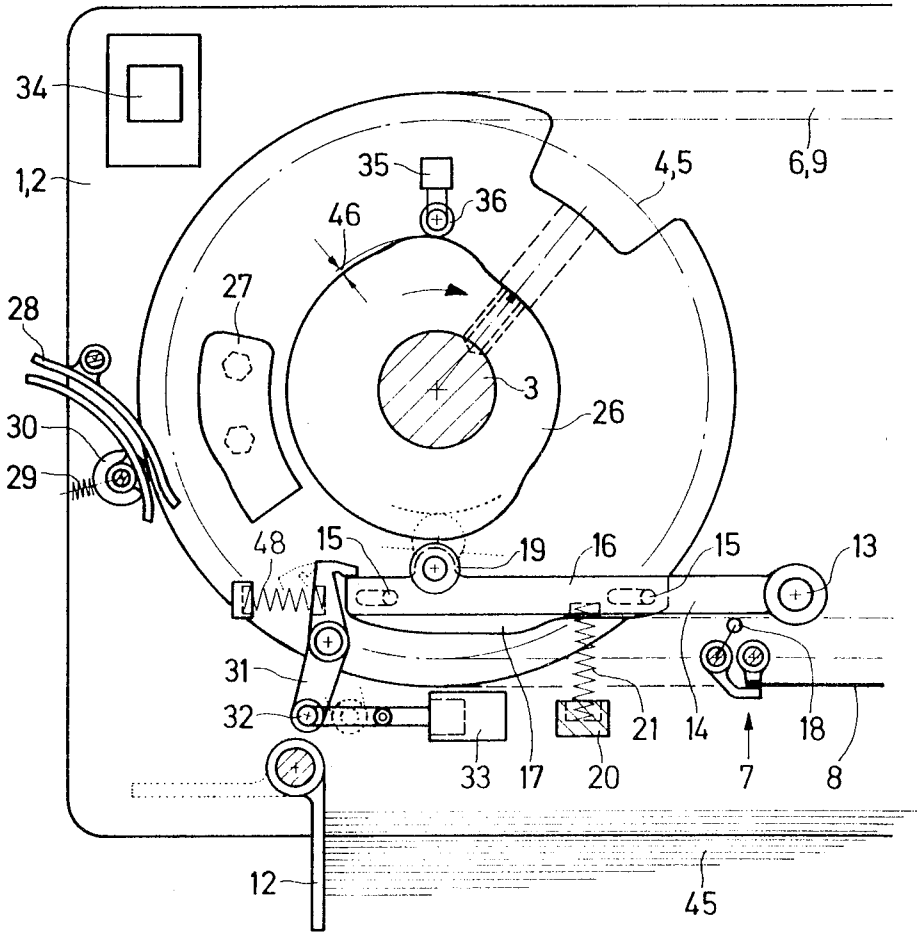
FIG. 4 is a view like that of FIG. 1 of another embodiment of the invention which includes modified means for operating a blocking device forming a part thereof.

FIG. 4 shows a configuration of the device according to the invention which is similar to those described hereinbefore. The essential difference is to be found in the fact that the initiation and realization of the printed-sheet withdrawal operation is not performed manually, but rather electromechanically.

In this regard, a locking lever 31 and the position thereof, respectively, are determined by a magnetic switch 33 acting upon a lower articulated point 32 thereof. During the pile-forming delivery of the sheets and as long as the magnetic switch 33 is not activated, the locking lever 31 is pivoted against the cam lever 16, due to the spring force of a compression spring 34, and fixes the cam lever 16 so as to render effective the gripper opening cam 17 attached thereto.

For actuating the magnetic switch 33, the compression or selector switch 34 which has been provided at the end region of the lateral wall section 2 and, via relatively simply constructed specific electrical control elements, initiates the withdrawal of individual paper sheets or, via time relays and meter or counter switches, also the withdrawal of a specific number of paper sheets, can be initiated. A counter unit 35 can be provided, for this purpose, with a sensing roller 36 for scanning the control cam 26 and thus counting, respectively, the number of revolutions thereof and the number of printed sheets 8 which are delivered. A small extra lift 46 on the control cam 26 provided for in both of the embodiments of FIGS. 3 and 4 permits, respectively, the latching of the locking lever 22, 31 in the initial position at the pertinent instant.

Figure 5:
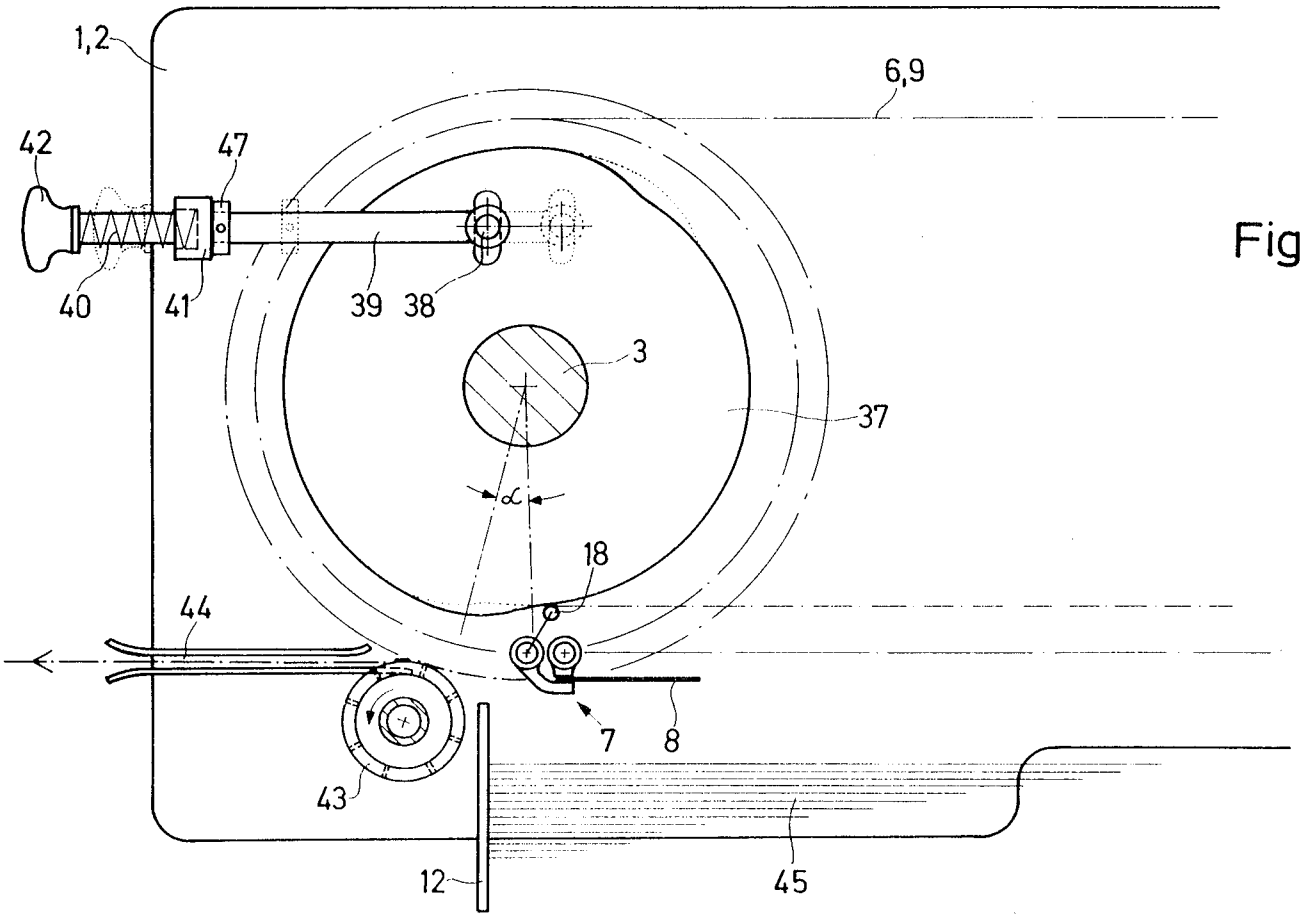
FIG. 5 is also a view like those of FIGS. 1 and 4 of a third embodiment of the invention wherein only a single gripper opening cam is used.

Another beneficial solution to the problem which is presented is apparent from FIG. 5. In this embodiment of the invention, the withdrawal of the printed sheets can be effected in an even easier manner. For this purpose, in the upper region of the gripper opening cam 37, rotatably mounted on the shaft 3 and formed as a disc, a drawbar 39 projecting from the end region of the lateral wall section 2 is linked to an articulated point 38. A stop 47 fixed to the drawbar 39, as well as a compression spring 40, both of which are supported by or braced against a holding device 41 fixed to the lateral wall 2, determine the position of the drawbar 39 as illustrated in FIG. 5 and, hence, the position of the gripper opening cam 37. To this effect, the resilient force of the compression spring 40 is selected so as to prevent an unintentional displacement of the gripper opening cam 37 due to the action of the cam roller 18 of the grippers 7 upon the gripper opening cam 37.

For the purpose of initiating the printed-sheet withdrawal operation, the drawbar 39 is forced, for example, manually, via the handle 42, against the resilient force of the compression spring 40, as well as opposite to the sheet travel direction, towards and into the position thereof shown in dotted lines. Simultaneously, the gripper opening cam 37 is turned through a rotary angle in clockwise direction. In this way, the sheet releasing point is transferrable beyond the front sheet stops 12. This operation can take place within a very short period of time.

The gripper opening cam 37 is consequently transferrable into two end positions which can be determined, on the one hand, through the striking of the handle 42 against the rear region of the lateral wall section 2 and, on the other hand, through the striking of the stop 47 against the holding device 41.

As a consequence of this, the opening of the grippers via the cam roller 18 running along the gripper opening cam 37 is delayed and, indeed, only when the sheet has already been conveyed above the pile 45. Immediately after the delayed disengagement of the paper sheet 8, the latter is taken over by a rotating suction roller 43 which ensures the subsequent conveying and guidance thereof without marking through a guide channel 44, and outwardly from there.

The solution of the problem illustrated in FIG. 5 is relatively simple, economical and efficient, an essential advantage there being found in the utilization of a single gripper opening cam.

The foregoing is a description corresponding, in substance, to German application No. P 33 22 342.4, dated June 22, 1983, International priority of which is being claimed for the instant application. Any material discrepancies between the foregoing specification and the specification of the aforementioned corresponding German application are to be resolved in favor of the latter.

There are claimed:

1. A device for withdrawing printed sheets from a delivery of a sheet-fed rotary printing machine for examination and sorting purposes, the delivery being a chain delivery with rear sprocket wheels and with gripper rows attached to the chain and having grippers openable by cam control, withdrawal of the printed sheets being initiated by a delayed opening of the respective grippers, comprising a first gripper-opening cam pivotable about an articulating point means for applying a spring biasing force to said first gripper-opening cam, an additional cam roller carried by said first gripper-opening cam, an arresting-lever mechanism for releasing said first gripper-opening cam from a locked position thereof so that it is engageable via said additional cam roller with a rotating control cam mounted on a shaft of the rear sprocket wheels of the chain delivery, said first gripper-opening cam being pivotable via said rotating control cam into respective positions wherein opening of the grippers if effected and is prevented, a second gripper-opening cam for initiating a delayed opening of the grippers, said second gripper-opening cam being disposed downstream from said first gripper-opening cam in travel direction of the printed sheets, and means for feeding the printed sheets released from the grippers, when the grippers are opened, directly to a conveyance device for further transporting the printed sheets.

2. Device according to 1 wherein said arresting lever mechanism includes an arresting lever manually actuable for bringing said first gripper-opening cam into a position wherein it is supported and a position wherein it is free of support.

3. Device according to claim 1 including electromechanical means for actuating said arrester lever so as to bring said first gripper-opening cam into a position wherein it is supported, said electromechanical means including a magnetic switch activatable via a selector switch for actuating said arrester lever so that a varying number of the printed sheets can be withdrawn selectively, and a counting device engaging said control cam for counting the number of the printed sheets which are withdrawn.

4. Device according to claim 1 wherein said control cam has a rise found therein via which said arresting lever is automatically returnable under spring bias at a predetermined time to an initial position thereof wherein said first gripper opening cam is supported.

5. Device according to claim 1 wherein said second gripper-opening cam is stationary, and said conveyance device is located close to said second gripper-opening cam, said conveyance device comprising a guide channel and transport rollers cooperating with the guide channels for feeding to the outside a printed sheet disengaged from the grippers.

6. Device according to claim 1 including lateral frame walls supporting the delivery, said releasing means comprising a pawl mechanism with actuating means therefor located at an end region of one of said lateral frame walls.

7. Device for withdrawing printed sheets from a delivery of a sheet-fed rotary printing machine for examination and sorting purposes, the delivery being a chain delivery with gripper rows attached to the chain and having grippers openable by cam control, withdrawal of the printed sheets being initiated by a delayed opening of the respective grippers, comprising a gripper-opening cam in the form of a disc and mounted on a rotatable shaft, a drawbar directly engaging said gripper-opening cam, said drawbar having an end thereof projecting beyond a rear region of a side wall whereon the chain delivery is supported, and a handle mounted on said drawbar end for manually moving said drawbar horizontally in and opposite the direction of travel of the printed sheet into two end positions, said gripper-opening cam being pivotable out of an end position wherein a sheet is released above a sheet pile into an end position wherein a sheet is released away from a sheet pile and taken up by a conveyor device and conveyed to the outside.

8. Device according to claim 7 including a compression spring and a stop on said drawbar for retaining said gripper-opening cam in a given position for forming a sheet pile, said handle having stops at said rear region of said side wall for determining an end position wherein a printed sheet is withdrawn.

9. Device according to claim 7 wherein said conveyor device comprises a guide channel and a suction roller cooperating with said guide channel.

* * * * *